US009233282B2

(12) United States Patent
Stites et al.

(10) Patent No.: US 9,233,282 B2
(45) Date of Patent: Jan. 12, 2016

(54) GOLF CLUBS AND GOLD CLUB HEADS WITH ADJUSTABLE CENTER OF GRAVITY AND MOMENT OF INERTIA CHARACTERISTICS

(71) Applicant: NIKE, Inc., Beaverton, OR (US)

(72) Inventors: John T. Stites, Weatherford, TX (US); Robert Boyd, Flower Mound, TX (US); David N. Franklin, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 100 days.

(21) Appl. No.: 13/852,789

(22) Filed: Mar. 28, 2013

(65) Prior Publication Data

US 2013/0337937 A1 Dec. 19, 2013

Related U.S. Application Data

(63) Continuation of application No. 12/576,688, filed on Oct. 9, 2009, now Pat. No. 8,409,031, which is a continuation-in-part of application No. 12/016,114, filed on Jan. 17, 2008, now Pat. No. 7,988,568.

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/047* (2013.01); *A63B 53/0466* (2013.01);
(Continued)

(58) Field of Classification Search
CPC .. A63B 53/06; A63B 53/047; A63B 59/0074; A63B 53/0487; A63B 2071/0694; A63B 53/0466; A63B 2053/0433; A63B 2053/0491
USPC ..... 473/334–339, 350
See application file for complete search history.

(56) References Cited

U.S. PATENT DOCUMENTS 1,133,129 A * 3/1915 Govan ..... 473/337
1,534,600 A * 4/1925 Mattern ..... 473/337
(Continued)

FOREIGN PATENT DOCUMENTS

CN 2922962 7/2007
EP 1 752 198 2/2007
(Continued)

OTHER PUBLICATIONS

ISR and Written Opinion issued in corresponding PCT/US2010/050196 mailed Jan. 11, 2011.
(Continued)

*Primary Examiner* — Stephen Blau
(74) *Attorney, Agent, or Firm* — Banner & Witcoff, Ltd.

(57) ABSTRACT

Golf clubs, club heads, and club weighting systems may include: (a) a club head body member; and (b) one or more weight members removably and/or movably engaged with the club head body member so as to move between a first position and a second position to change an overall exterior shape of the club head. This shape change may result in changes to the overall center of gravity, weighting, and/or moment of inertia characteristics of the club head. Alternatively or additionally, the weight member(s) may be removed from the club head body member, reoriented, and/or replaced with a different weight member, e.g., to change the overall exterior shape, center of gravity, weighting, and/or moment of inertia characteristics of the club head. Methods of making and using these clubs, club heads, and weighting systems also are described.

17 Claims, 15 Drawing Sheets

(51) Int. Cl.
*A63B 59/00* (2015.01)
*A63B 71/06* (2006.01)

(52) U.S. Cl.
CPC ..... *A63B 53/0487* (2013.01); *A63B 59/0074* (2013.01); *A63B 2053/0433* (2013.01); *A63B 2053/0491* (2013.01); *A63B 2071/0694* (2013.01)

(56) References Cited

U.S. PATENT DOCUMENTS

| | | | | |
|---|---|---|---|---|
| 2,517,245 | A * | 8/1950 | Scott | 473/339 |
| 3,652,094 | A * | 3/1972 | Glover | 473/337 |
| 4,085,934 | A * | 4/1978 | Churchward | 473/338 |
| 4,195,842 | A | 4/1980 | Coleman | |
| 4,754,977 | A * | 7/1988 | Sahm | 473/337 |
| 4,811,950 | A * | 3/1989 | Kobayashi | 473/335 |
| 4,869,507 | A * | 9/1989 | Sahm | 473/337 |
| 5,242,167 | A * | 9/1993 | Antonious | 473/350 |
| 5,297,794 | A | 3/1994 | Lu | |
| 5,429,356 | A | 7/1995 | Dingle | |
| 5,433,444 | A * | 7/1995 | Chiuminatta et al. | 473/240 |
| 5,688,189 | A | 11/1997 | Bland | |
| 5,722,177 | A | 3/1998 | Reilly, III | |
| 5,769,737 | A | 6/1998 | Holladay et al. | |
| 5,916,042 | A * | 6/1999 | Reimers | 473/334 |
| 5,993,324 | A * | 11/1999 | Gammil | 473/251 |
| 6,015,354 | A | 1/2000 | Ahn et al. | |
| 6,077,173 | A * | 6/2000 | Stites | 473/334 |
| 6,692,371 | B2 | 2/2004 | Berish et al. | |
| 6,773,360 | B2 * | 8/2004 | Willett et al. | 473/334 |
| 6,991,555 | B2 | 1/2006 | Reese | |
| 7,108,609 | B2 * | 9/2006 | Stites et al. | 473/256 |
| 7,153,220 | B2 * | 12/2006 | Lo | 473/335 |
| 7,156,752 | B1 | 1/2007 | Bennett | |
| 7,201,669 | B2 * | 4/2007 | Stites et al. | 473/337 |
| 7,204,765 | B2 | 4/2007 | Cover et al. | |
| 7,404,772 | B2 | 7/2008 | Koide et al. | |
| 7,520,820 | B2 | 4/2009 | Dimarco | |
| 7,566,276 | B2 | 7/2009 | Billings | |
| 7,749,100 | B2 | 7/2010 | Tavares et al. | |
| 7,824,280 | B2 * | 11/2010 | Yokota | 473/334 |
| 7,871,339 | B2 * | 1/2011 | Sanchez et al. | 473/335 |
| 2004/0214657 | A1 | 10/2004 | Hou | |
| 2005/0009625 | A1 | 1/2005 | Stites et al. | |
| 2005/0137024 | A1 | 6/2005 | Stites et al. | |
| 2006/0035717 | A1 | 2/2006 | Cover et al. | |
| 2006/0172816 | A1 | 8/2006 | Johnson | |
| 2006/0240907 | A1 | 10/2006 | Latiri | |
| 2007/0155534 | A1 | 7/2007 | Tsai et al. | |
| 2007/0207878 | A1 | 9/2007 | Tavares et al. | |
| 2007/0225085 | A1 | 9/2007 | Koide et al. | |
| 2007/0265109 | A1 | 11/2007 | Elmer | |
| 2008/0015051 | A1 * | 1/2008 | Roach et al. | 473/350 |
| 2008/0020861 | A1 | 1/2008 | Adams et al. | |
| 2008/0045354 | A1 | 2/2008 | Drew | |
| 2008/0132353 | A1 | 6/2008 | Hsiao | |
| 2008/0146370 | A1 | 6/2008 | Beach et al. | |
| 2008/0242444 | A1 | 10/2008 | Park et al. | |
| 2008/0261715 | A1 | 10/2008 | Carter | |
| 2009/0186717 | A1 | 7/2009 | Stites et al. | |

FOREIGN PATENT DOCUMENTS

| | | |
|---|---|---|
| WO | 2007/101350 | 9/2007 |
| WO | 2008008175 | 1/2008 |

OTHER PUBLICATIONS

English Translation of Nov. 28, 2012 Office Action issued in Chinese Application No. 200980105482.4.

ISR in the related PCT/US2009/030251 mailed Apr. 15, 2009.

English Translation of Dec. 5, 2012 Office Action issued in Japanese Application No. 2010-543158.

Feb. 22, 2012 Office Action issued in Chinese Application No. 200980105482.4.

Notice of Reasons for Rejection (with English translation) dated Oct. 23, 2013 for JP Application No. 2012-533203.

Jul. 29, 2009—(WO) International Preliminary Report on Patentability—App PCT/US2009/030251.

* cited by examiner

GOLF CLUBS AND GOLD CLUB HEADS WITH ADJUSTABLE CENTER OF GRAVITY AND MOMENT OF INERTIA CHARACTERISTICS

RELATED APPLICATIONS

This application is a continuation application of U.S. patent application Ser. No. 12/576,688, filed Oct. 9, 2009, which is a continuation-in-part application of U.S. patent application Ser. No. 12/016,114, filed Jan. 17, 2008, now U.S. Pat. No. 7,988,568, issued Aug. 2, 2011, all of which applications are hereby incorporated by reference herein and made a part hereof.

FIELD OF THE INVENTION

This invention relates to golf clubs, golf club heads, and methods for making and using golf clubs and golf club heads.

BACKGROUND

Various golf club heads and golf club products have been designed to improve a golfer's accuracy by assisting the golfer in squaring the club head face at impact with a golf ball. For example, a number of golf club heads have weight strategically positioned in order to alter the location of the club head's center of gravity and/or to increase the club head's moment of inertia (e.g., resistance to twisting). The location of the center of gravity of the club head and its degree of twist at impact are factors that, at least in part, determine whether a golf ball will be propelled in the intended direction when struck. When the center of gravity is positioned behind the ball's point of engagement on the contact surface and the club head is square to the intended target line, the golf ball generally will follow a straight route. When the center of gravity is spaced to a side of the ball's point of engagement and/or the club head is not square at impact, however, the golf ball may follow a route that curves left or right, or it may simply fly to the left or right, ball flights often referred to as "draws," "fades," "hooks," "slices," "pulls," or "blocks." Similarly, when the center of gravity of the club head is spaced above or below the point of engagement with the ball, the flight of the golf ball may exhibit more boring or climbing trajectories, respectively. Proper and consistently repeatable golf ball striking can be quite difficult and frustrating to achieve, particularly for beginning players, youngsters, or occasional recreational players.

Golf club heads, such as cavity back and/or perimeter weighted club heads, assist some golfers by locating much of the weight of the club head around the club head's perimeter. Generally, these golf club heads are more "forgiving" than non-cavity, non-perimeter weighted golf club heads, thereby allowing a golf ball to be struck somewhat off center or otherwise mis-hit, while still providing relatively good distance and accuracy. Cavity back and/or perimeter weighted club heads have helped the average golfer reduce mis-hits and improve scoring.

While golf club technology has improved in recent years, there remains room in the art for still further advances and improvements in golf club technology. Additionally, there is room in the art for improvements to golf clubs for use by youngsters, beginners, and/or high handicappers, e.g., to help them develop and improve their game and make the ball easier for them to hit more consistently and accurately.

SUMMARY OF THE INVENTION

This invention relates to golf club heads and golf clubs including such golf club heads, e.g., including putters, irons, hybrids, and woods. Golf club heads according to at least some example aspects of this invention may include: (a) a club head body member having a ball-striking face, a rear surface behind the ball striking face and a cavity defined therein, a sole, an upper end, a toe end and a heel end, wherein the heel end is adjacent to a shaft-connecting member; and (b) at least one weight member removably engaged at least partially within the cavity defined in the rear surface, wherein the at least one weight member, when engaged, shifts the center of gravity of the golf club head. The movement, replacement, or removal of the weight member may change weighting of the club head to shift the center of gravity lower, higher, toward the toe and/or toward the heel of the golf club head. The clubs may be used with the various weight members arranged in any of their potential positions. Further, the clubs may include a set of weight members of varying weights so that the weighting of the club head may be incrementally adjusted by replacing lighter weights with heavier weights or heavier weights with lighter weights. Alternatively, the clubs may be used with the various weight member(s) removed.

If desired, the weight member may take the form and/or appearance of a portion of the overall club head body member. The club head may be used to hit balls with the weight member(s) secured at either a first or second position, or with the weight member or a portion of the weight member removed. Alternatively or additionally, if desired in at least some examples of this invention, one or more of the weight members may be removed from the club head body member, reoriented in a different manner (to thereby change the overall exterior shape, center of gravity, weighting, and/or moment of inertia characteristics of the club head), and/or replaced with a different weight member (which also may change the overall exterior shape, center of gravity, weighting, and/or moment of inertia characteristics of the club head). Golf clubs in accordance with at least some examples of this invention may include club heads and/or weighting systems of the types described above, along with a shaft member attached to the club head, a handle member integral with or attached to the shaft, and/or a grip member integral with or attached to the shaft.

Additional aspects of this invention relate to methods for making and/or using golf club heads and golf clubs with shape, center of gravity, weighting, and/or moment of inertia alteration capabilities, e.g., of the various types described above. Methods of making golf club heads in accordance with at least some examples of this invention may include: (a) providing a club head body member having a ball-striking face, a rear surface behind the ball striking face and a cavity defined therein, a sole, an upper end, a toe end and a heel end, wherein the heel end is adjacent to a shaft-connecting member; and (b) removably engaging at least one weight member at least partially within the cavity defined in the rear surface, wherein the at least one weight member, when engaged, shifts the center of gravity of the golf club head. Methods of making golf clubs in accordance with at least some example aspects of this invention may include: (a) providing a golf club head comprising a club head body member having a ball-striking face, a rear surface behind the ball striking face and a cavity defined therein, a sole, an upper end, a toe end and a heel end, wherein the heel end is adjacent to a shaft-connecting member; (b) removably engaging at least one weight member at least partially within the cavity defined in the rear surface, wherein the at least one weight member, when engaged, shifts the center of gravity of the golf club head; and (c) engaging a shaft member with the golf club head. As noted above, if desired, the weight member may take the form or appearance of at least a portion of the overall club head body (at least at one of its mounting positions).

Various ways of shifting the weighting of the club head (and thus its center of gravity and/or moment of inertia characteristics) may be used without departing from this invention. More specific examples include: (a) moving the weight member from a first position to a second position (e.g., by sliding it, moving it, rotating it, etc.); (b) moving and/or removing the weight member and reorienting at least a portion of it to another position; and/or (c) exchanging one weight member for another having a different size, shape, weight and/or orientation characteristic.

BRIEF DESCRIPTION OF THE DRAWINGS

The present invention is illustrated by way of example and not limited in the accompanying figures, in which like reference numerals indicate similar elements throughout, and in which.

DETAILED DESCRIPTION

Figure 1A:
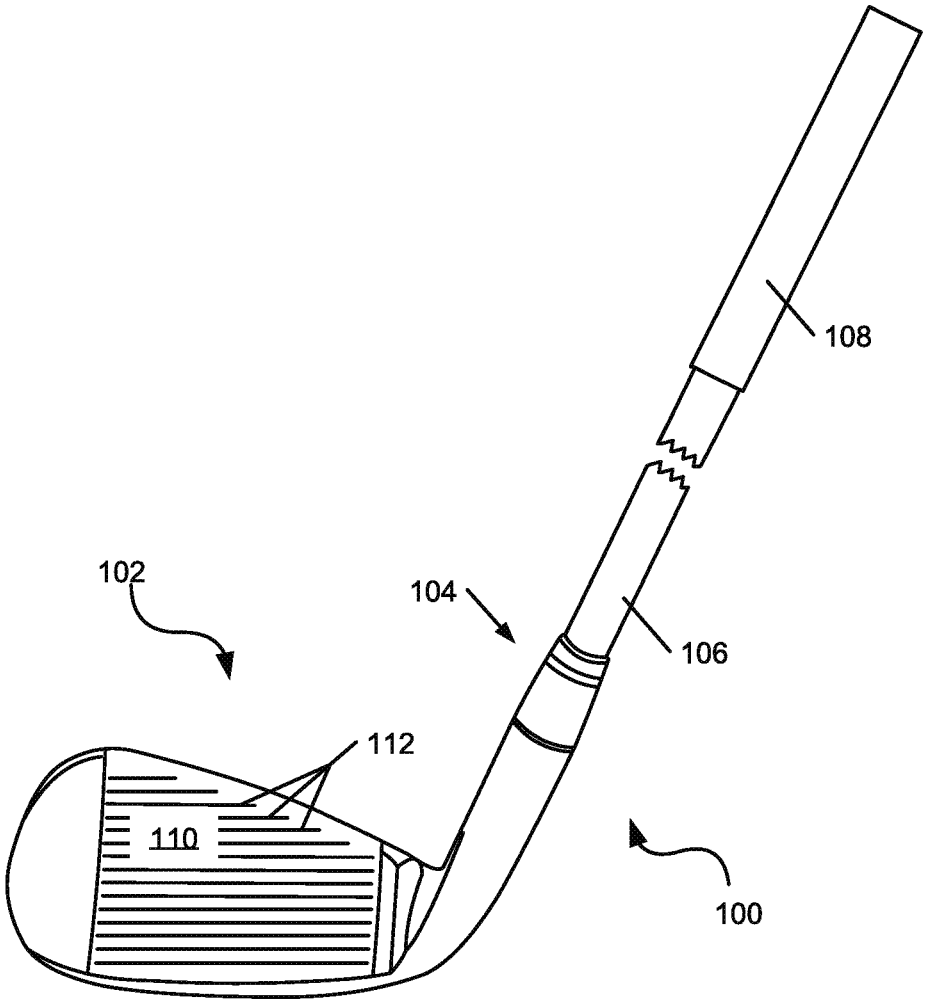
FIGS. 1A through 1E illustrate example features of example golf clubs and golf club heads in accordance with this invention (iron-type golf clubs and golf club heads are illustrated)

The following description and the accompanying figures disclose various example features of golf clubs and golf club heads in accordance with the present invention (e.g., woods, irons, hybrids, putters, etc.).

I. General Description of Aspects of the Invention

A. Golf Club Heads and Golf Clubs

Aspects of this invention relate to golf club heads and golf clubs including such golf club heads, including putter heads, putters, iron-type club heads, iron-type golf clubs, wood-type golf club heads, and wood-type golf clubs. Golf club heads according to at least some example aspects of this invention may include: (a) a club head body member (e.g., including one or more individual parts, such as one or more parts forming a ball striking face, a sole, a crown, and/or a body of the club head); and (b) one or more weight members engaged with the club head body member. The weight member(s) may be movably or removably engaged with the club head body member so as to move between a first position and a second position, to be exchangeable with weight members of varying weights, or to be removed. The movement or removal of the weight member may change the exterior or perimeter shape of the club head to extend the club head structure in the rearward, heel, and/or toe direction(s); change the perimeter shape of the club head structure, particularly in the rearward, heel, and/or toe direction(s); and/or move the center of gravity in the rearward, heel, and/or toe direction(s). The movement of the weight member may also change the perimeter shape of the club head to shift the center of gravity lower or higher, i.e, towards the sole of the club head or towards the top of the club head, respectively, thus effecting the trajectory of a ball in flight.

In at least some examples of this invention, the weight member(s) may be removed from or moved with respect to the club head body member and reoriented in a different manner (to thereby change the overall exterior shape of the club head) or it (they) may be replaced with a different weight member(s) (which also may change the overall exterior or perimeter shape of the club head). Movement between first and second positions and/or otherwise changing the weight member(s) and/or their orientation may be used to change the overall shape of the club head body member, which in turn may be used to change (and control) the overall center of gravity, weighting, and/or moment of inertia characteristics of the club head. Weight members may be produced in any desired size, shape, and form without departing from the invention, e.g., to produce the ultimately desired club head shape, weighting, center of gravity, and/or moment of inertia characteristics. In some examples, the weight member(s) may form or appear as an integral and/or continuous part of the overall club head structure, at least in some positions.

Golf clubs in accordance with examples of this invention may include club heads, e.g., of the types described above, along with one or more of a shaft member attached to the club head (e.g., directly engaged, extending into, via a hosel element, etc.), a handle member integral with or attached to the shaft, a grip member integral with or attached to the shaft or handle member, etc.

Weight members may move with respect to the club head body member to change the overall exterior shape of the club head structure in any manner without departing from the invention. In accordance with at least some examples of this invention, the weight member(s) may be rotatably engaged with the club head body member to pivot between the first position and the second position (e.g., via a hinge or axle type element, etc.). In other examples, the weight member(s) may be slidably engaged with the club head body member to move between the first position and the second position (e.g., slidably mounted on a rail extending from the club head body member or the weight member, sliding into a receptacle (e.g., groove or slot) defined in the club head body member or the weight member, etc.). As still another example, the weight member(s) may be movably or removably mounted with respect to the club head body member by releasably securing it (them) to the body member, e.g., with a threaded arrangement; a set screw; a pin member; a spring-loaded securing mechanism; one or more retaining detents, grooves, or other retaining elements; mounted on a raised boss element; etc.

In a first position, the weight member(s) in at least some example structures according to the invention may extend from the club head body member in a direction at least partially toward a front of the club head body member. In contrast, at the second position, these weight member(s) may extend from the club head body member in a direction at least partially away from the front of the club head body member. The weight member(s) also may take on any desired form without departing from the invention, such as a bridge member (e.g., extending across a rear cavity of an iron or putter type structure), a weighted body portion, a weight element secured to a club head body component, etc. Also, the weight member(s) may be movable with respect to the club head body member in a variety of different ways and a variety of different directions without departing from this invention, including, for example, one or more of: in a front-to-rear direction with respect to the club head body member (e.g., by sliding, rolling, rotating, etc.); in a heel-to-toe direction with respect to the club head body member (e.g., by sliding, rolling, rotating, moving etc.); at an acute angle with respect to the front-to-rear direction; in a sole-to-top direction with respect to the club head body member; etc.

B. Methods

Still additional aspects of this invention relate to methods for making and/or using golf club heads and golf clubs in accordance with examples of this invention, e.g., of the various types described above. Methods of forming golf club heads in accordance with at least some examples of this invention may include: (a) providing a club head body member (e.g., by making it, obtaining it from an independent source or supplier, etc.); and (b) removably and/or movably engaging one or more weight members with the club head body member. The one or more of the weight members may be engaged with the club head body member so as to be movable between a first position and a second position to thereby change an overall exterior shape of the club head. Movement of the weight member(s) may be used, for example, to change the center of gravity, weighting, and/or moment of inertia characteristics of the club head. The one or more weight members may also be removably engaged with the club head body member so that the weight members may be replaced with heavier or lighter members, or may be removed altogether, to further alter the center of gravity, weighting, and/or moment of inertia characteristics of the club head.

The weight members may be movable with respect to the club head body member in any desired manner without departing from the invention, including: by rotating between the first position and the second position; by sliding between the first position and the second position; by moving between a first and second position; by removing and replacing; etc. Methods according to at least some examples of this invention further may include: securing the weight member in place with respect to the club head body member and/or moving the weight member between the first and second positions (e.g., in a front-to-rear direction, in a heel-to-toe direction, in an angled direction (e.g., with respect to the vertical, horizontal, heel-to-toe, and/or front-to-rear directions), in a rotational direction, in combinations of various different directions, etc.).

Methods of making golf clubs in accordance with at least some example aspects of this invention may include: (a) providing a club head (e.g., by making it, by obtaining it from an independent source or supplier, etc.), wherein the club head includes a club head body member and at least one weight member engaged with the club head body member, wherein the at least one weight member is movable between a first position and a second position to change an overall exterior shape of the club head; and (b) engaging a shaft member with the club head. The club head may be of any desired structure, such as the various structures described above. The shaft member additionally may include or be engaged with a handle member and/or a grip element. The one or more weight members may also be removably engaged with the club head body member so that the weight members may be replaced with heavier or lighter members, or may be removed altogether, to further alter the center of gravity, weighting, and/or moment of inertia characteristics of the club head.

Additional methods according to at least some examples of this invention relate to methods of changing weighting and/or moment of inertia characteristics of a golf club head. Such methods may include: (a) moving the weight member from a first position to a second position (e.g., by sliding it, rotating it, or removing and replacing it; etc.); (b) moving and/or removing the weight member and reorienting at least a portion of it in another manner; and/or (c) by exchanging one weight member for another having a different size, shape, and/or orientation characteristics.

Given the general description of aspects of the invention provided above, more detailed descriptions of various specific examples of golf clubs and golf club head structures according to the invention are provided below.

II. Detailed Description of Example Golf Club Heads and Golf Club Structures According to the Invention FIGS. 1A through 1E generally illustrate a golf club 100 including features in accordance with at least some examples of this invention. As shown in FIG. 1A, the golf club 100 includes a club head 102, a hosel region 104, a shaft member 106 connected to the club head 102 via the hosel region 104, and a grip member 108 attached to the shaft member 106. The shaft member 106 may be made from any desired material(s), and it may be connected to the club head 102 in any desired manner, including from conventional materials and in conventional manners known and used in the art (e.g., constructed from one or more of metals, graphite, composite materials, etc., and attached via one or more of threads, mechanical connectors, cements, adhesives, etc.). Additionally, the grip member 108 may be made from any desired material(s), and it may be connected to or formed with the shaft member 106 in any desired manner, including from conventional materials and in conventional manners known and used in the art (e.g., constructed from one or more of rubber materials, leather, polymeric materials, cord-embedded rubber materials, etc., and attached via one or more of threads, mechanical connectors, cements, adhesives, etc.).

As further shown in FIG. 1A, the club head 102 includes a ball striking face 110, that may include grooves 112 formed therein for removing water, grass, and/or other materials from between a ball and the ball striking face 110 when the club 100 strikes a golf ball. The ball striking face 110 may be integrally formed as part of the overall club head body structure (e.g., machined from the remainder of the club head 102 to form the striking face 110), or it may be a separate element applied to the club head body (e.g., by welding or fusing techniques, by cements or adhesives, by mechanical connectors, etc.). Those skilled in the art will appreciate that a specific iron-type club head structure like that illustrated in FIGS. 1A through 1E may take on any desired form, loft angle, lie angle, bounce angle, offset characteristics, and the like without departing from the invention. For example, if desired, the golf club 100 and its corresponding club head 102 may form any of: a zero iron, a one iron, a two iron, a three iron, a four iron, a five iron, a six iron, a seven iron, an eight iron, a nine iron, a ten iron, a pitching wedge, a lob wedge, a gap wedge, a sand wedge, an iron-type "hybrid" club, etc., and have any desired flat, neutral, or upright lie angle or other characteristics without departing from the invention.

Figure 1B:
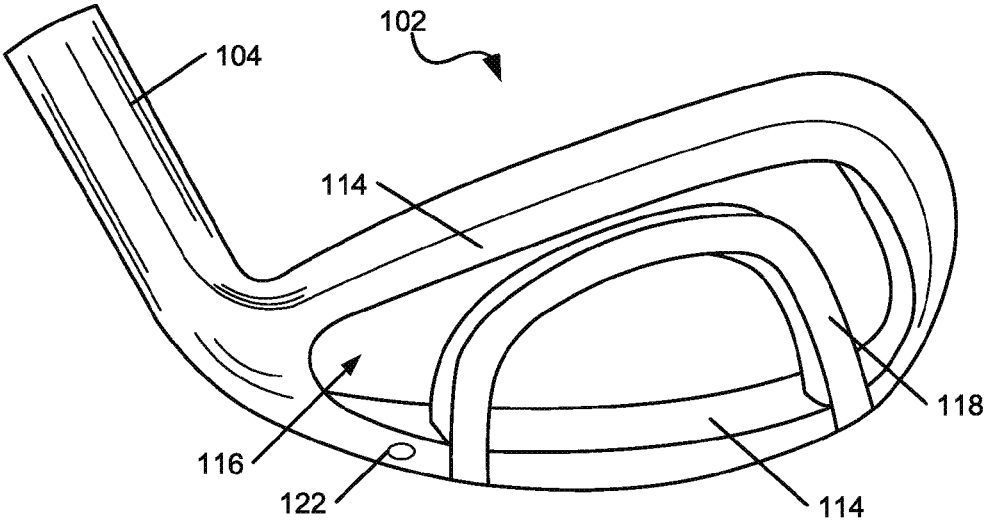
Figure 1C:
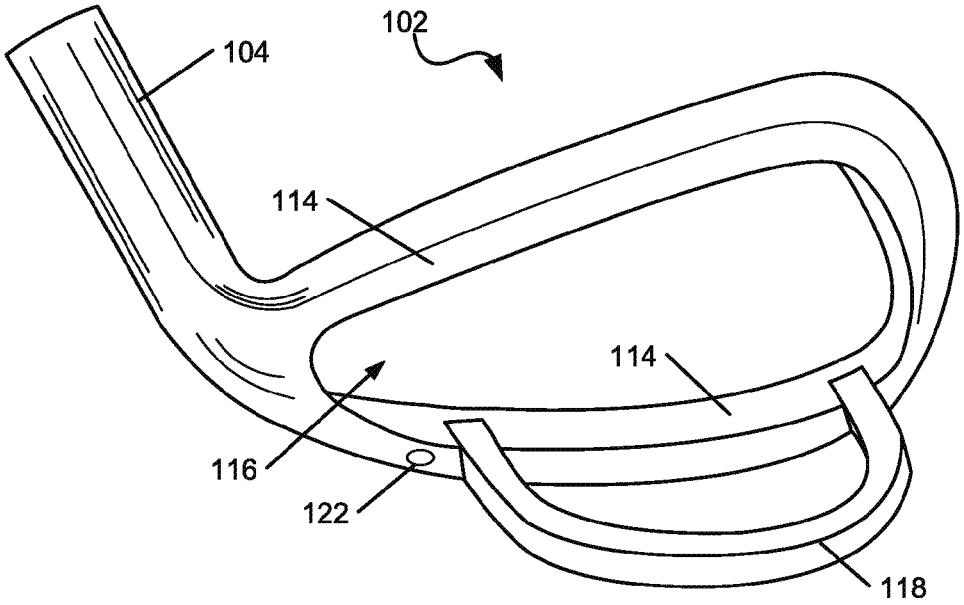

FIGS. 1B and 1C illustrate rear views of the example club head 102 of FIG. 1A. While the rear of the club head 102 may take on any desired form or shape without departing from the invention (e.g., a "blade" type iron, a hybrid type club iron, etc.), in this illustrated example, the club head 102 is formed as a perimeter weighted, cavity back club (note, for example, the perimeter weighting member(s) 114 and the rear cavity 116 defined behind the ball striking face 110). FIGS. 1B and 1C further illustrate a weight member 118 engaged at the rear of the club head 102. The weight member 118 may take on any desired form without departing from the invention. In this illustrated example, the weight member 118 constitutes a bridge member that extends along a portion of the rear cavity 116 of the club head 102 from the toe-to-heel direction. If desired, the weight member 118 may extend at least partially into the area defined by the rear cavity 116, although there is no requirement that it do so.

Figure 1D:
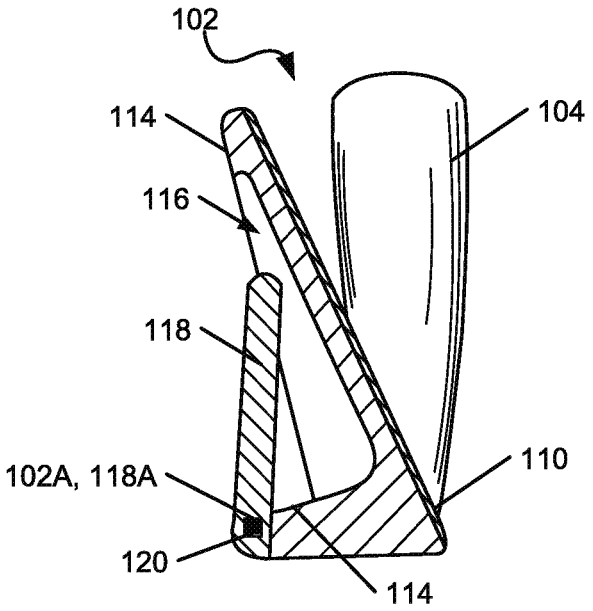
Figure 1E:
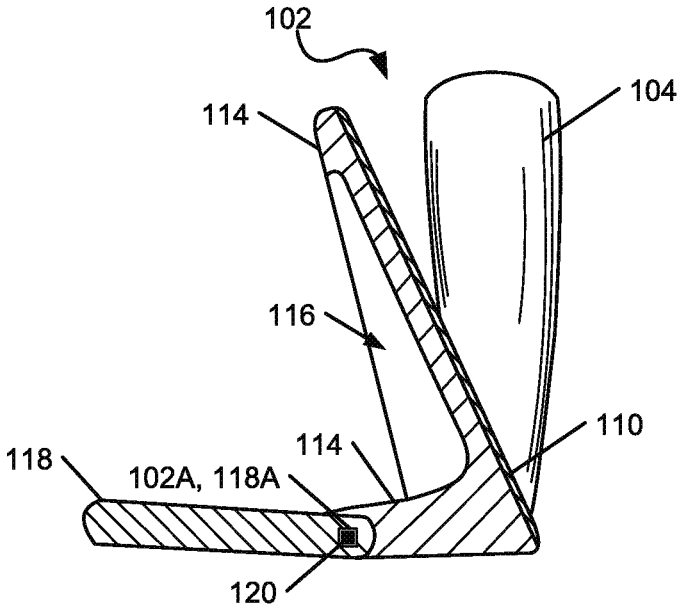

As evident from a comparison of FIGS. 1B and 1D with FIGS. 1C and 1E, the weight member 118 in accordance with this example of the invention is movable between an upright position (as shown in FIGS. 1B and 1D) and an extended position (as shown in FIGS. 1C and 1E). In its upright position, in this example structure 102, the weight member 118 extends from the club head body 102 (e.g., the lower perimeter weighting member 114) in a direction at least partially toward a front of the club head body 102 (e.g., toward the ball striking face 110). By moving the weight member 118 to its extended position (e.g., extending in a direction at least partially away from the front of the club head 102), as shown in FIGS. 1C and 1E, the overall center of gravity of the club head 102 is moved downward and rearward in the club head structure 102 (as compared to the center of gravity location with the weight member 118 at the upright position). Downward and rearward positioning of the club head's center of gravity tends to make the club 100 somewhat easier for golfers to use to get a ball airborne, with a higher loft, as compared to club heads with a higher and/or more forward center of gravity position (e.g., like that shown in FIGS. 1B and 1D). Also, placing the weight member 118 in the extended position shown in FIGS. 1C and 1E tends to increase the club head's moment of inertia (an indicator of the club head's resistance to twisting about at least one axis), which also can help golfers better launch a golf ball straighter and in the intended direction and avoid mis-hits. Therefore, orienting the weight member 118 in the extended position can be very useful, e.g., as a teaching aid, for youngsters or beginners, for high handicappers, etc.

The club head 102 and weight member 118 may be made of any desired materials without departing from this invention, including conventional materials known and used in the golf club construction art. As some specific examples, the club head body member 102 may be constructed from a lightweight material, such as lightweight stainless steel, titanium, nickel, magnesium, alloys, composites, polymers, and/or combinations thereof, and the weight member 118 may be constructed from and/or include a somewhat heavier material, such as lead, tungsten, or a lead-containing or tungsten-containing material (e.g., polymers or composites formed to include lead or tungsten, etc.). Of course, a wide variety of other materials and/or combinations of materials also may be used in the club head 102 construction without departing from this invention.

Any way of movably and/or removably mounting the weight member 118 with respect to the remainder of the club head 102 may be provided without departing from this invention. For example, a hinge or axle member about which the bridge member 118 is rotatably mounted may be provided. As another example, as illustrated in FIGS. 1D and 1E, if desired, a pin element 120 may be provided as a locking mechanism, removably extending through at least portions of the perimeter weighting structure 114 and the bridge member 118, to hold the bridge member 118 in place with respect to the club head 102. This pin member 120 may be readily removed by the user, if desired, via opening 122 for moving or changing positions and/or orientations of the bridge member 118 with respect to the remainder of the club head 102.

Also, any desired way of holding the bridge member 118 in place with respect to the club head body 102 may be used without departing from this invention. For example, if desired, the pin element 120 may be shaped (e.g., square, triangular, or other angular structures in cross section), at least in part, such that it will not allow rotation of the weight member 118 with respect to the club head 102 once the pin element 120 extends through openings 118A and 102A defined in the weight member 118 and the club head body 102, respectively (as shown in FIGS. 1D and 1E). As still additional examples, if desired, clamps, clasps, retaining elements, groove structures, detents, spring-loaded bolt members, and/or other mechanical elements may be provided to removably, movably, and/or releasably hold the weight member 118 in place with respect to the club head body 102. As still another example, if desired, a set screw, nut and bolt, or other type of threaded arrangement (e.g., pressing against and/or fitting into a recess and/or opening defined in the weight member 118) may be provided (e.g., through opening 122) to releasably lock the weight member 118 in place with respect to the club head body 102.

Additionally or alternatively, if desired, the weight member 118 and/or its locking mechanism may be designed so as to allow the weight member 118 to be secured at a variety of different positions without departing from the invention (e.g., at multiple positions between the upright position shown in FIG. 1B and the extended position shown in FIG. 1C). This may be accomplished in many different ways, e.g., using the various mechanisms described above (e.g., using a multi-sided pin element 120, using a set screw arrangement, etc.).

Figure 2A:
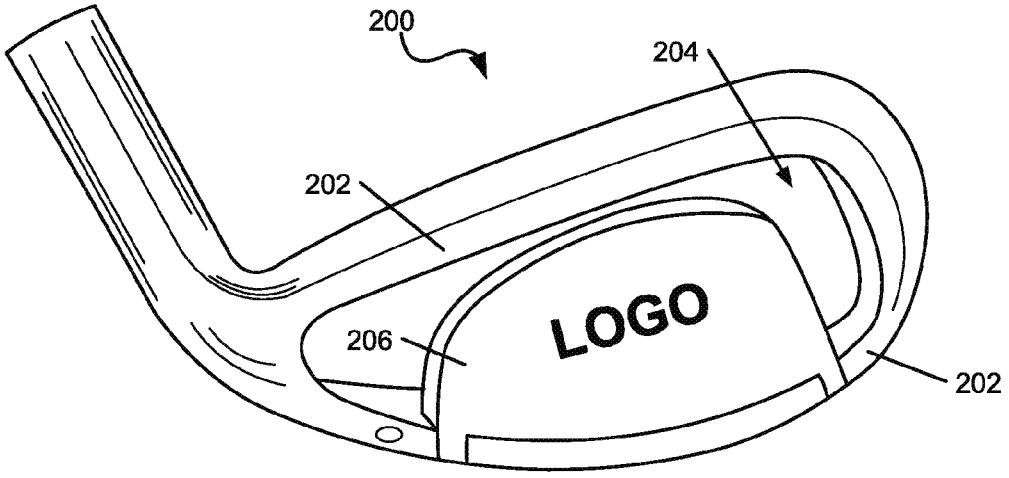
FIGS. 2A and 2B illustrate example features of additional example golf clubs and golf club heads in accordance with this invention (again, iron-type golf clubs and golf club heads are illustrated)
Figure 2B:
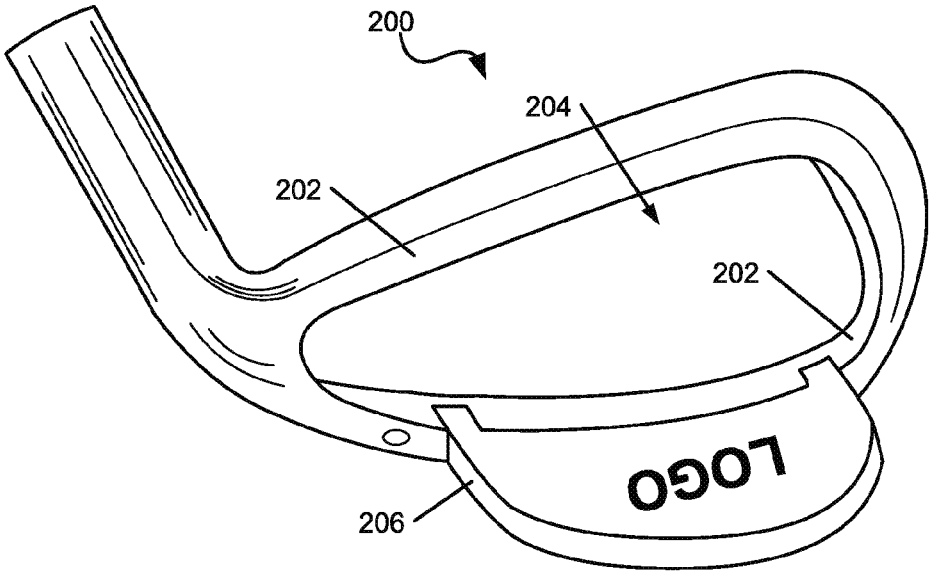

FIGS. 2A and 2B illustrate rear views of another example iron-type golf club head 200 that may be included in a golf club according to at least some examples of this invention. Again, in this example structure, the particularly illustrated club head 200 is formed as a perimeter weighted, cavity back club (note, for example, the perimeter weighting member(s) 202 and the rear cavity 204 defined in the back of the club head body 200), although any club head design may be used without departing from the invention (e.g., a "blade" type iron, a hybrid type club iron, etc.). In this illustrated example, however, the weight member 206 engaged at the rear of the club head 200 takes on a different form. More specifically, in this illustrated example, the weight member 206 does not include any open area, as illustrated in the example of FIGS. 1B and 1C. If desired, the example weight member 206 of FIGS. 2A and 2B may be formed by closing the open area of weight member 118 of FIGS. 1B and 1C (e.g., by attaching additional material to weight member 118, providing a screen or other cover member over weight member 118, etc.). Also, if desired, weight member 206 may extend at least partially into the area defined by the rear cavity 204, although there is no requirement that it do so. The weight member 206 also may be formed so as to be unevenly weighted across its overall width (e.g., in the club head heel-to-toe direction) and/or length (e.g., in the front-to-rear direction), such that the weight of member 206 can be positioned so as to favorably impact the center of gravity and/or moment of inertia characteristics of the club head 200 (e.g., toward the rear and/or outward areas of the club head 200), e.g., to customize these properties for a specific golfer and/or swing type.

As evident from a comparison of FIGS. 2A and 2B, weight member 206 in accordance with this example of the invention is movable between an upright position (as shown in FIG. 2A) and an extended position (as shown in FIG. 2B). This example weight member 206 may be oriented, positionable, movable, and lockable in place in any desired manner without departing from the invention, including the various manners described above in conjunction with the example of FIGS. 1A through 1E. The club head 200 according to this example structure also may have the favorable center of gravity and/or moment of inertia adjustability properties described above in conjunction with FIGS. 1A through 1E. This club head 200 and its associated weight member 206 also may be made from any desired materials, including the various specific materials described above for use in conjunction with the club head structure 102 of FIGS. 1A through 1E. Of course, if desired, the weight member 206 and/or its locking mechanism may be designed so as to allow the weight member 206 to be secured at a variety of different positions with respect to the club head body 200 without departing from the invention (e.g., at multiple different positions between the upright position shown in FIG. 2A and the fully extended position shown in FIG. 2B). Additionally, if desired, the weight member 206 may be constructed from multiple independent pieces and/or have any desired number of connections to the remainder of the club head body 200.

FIGS. 3A through 3D illustrate still additional example features of a golf club head 300 that may include a movable/removable weighting system in accordance with at least some examples of this invention. FIGS. 3A through 3D illustrate a perimeter weighted, cavity back iron-type club head 300 similar to the general structures described above in conjunction with FIGS. 1A through 2B (note the perimeter weighting member 302 and the recess or cavity 304), although any style of club head body may be provided without departing from the invention. In this example structure 300, the lower perimeter portion 302 of the club head 300 includes two raised boss members 306. These raised boss members 306 may be formed in any desired manner, in any desired sizes, and/or in any desired shapes without departing from the invention. Moreover, if desired, the boss members 306 need not be constructed of the same sizes or shapes and/or in the same manner. In at least some examples, the boss members 306 may be integrally formed as part of the overall club head structure 300, e.g., by conventional techniques known and used in the club making art, such as molding, casting, forging, or the like, or they may be separate elements engaged with the remainder of the club head structure 300, e.g., by threads, by mechanical connectors, by cements, etc.

Figure 3A:
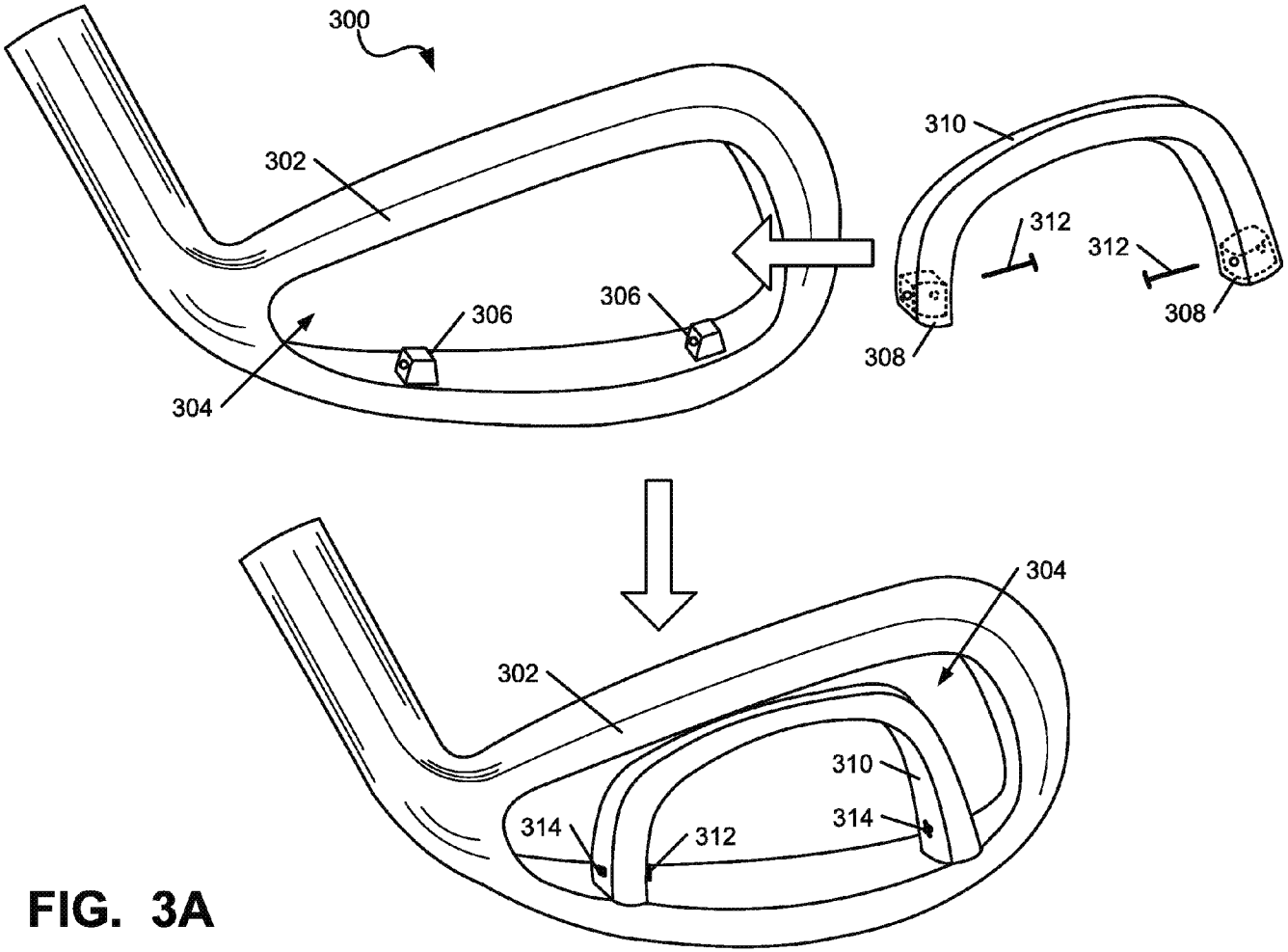
FIGS. 3A through 3D illustrate example features of additional example golf clubs and golf club heads in accordance with this invention (again, iron-type golf clubs and golf club heads are illustrated)
Figure 3D:
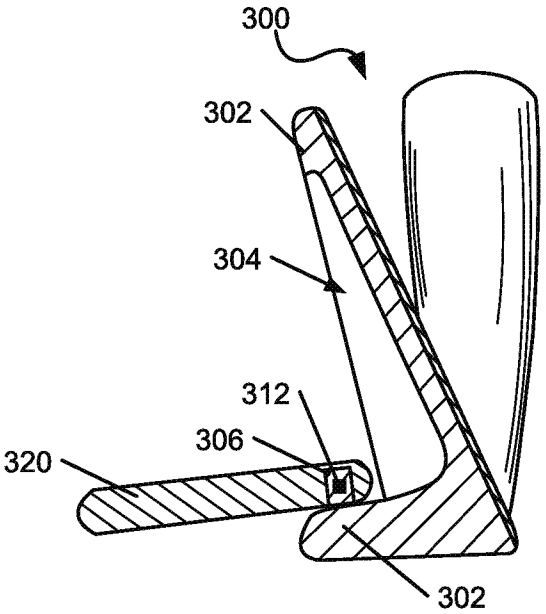
Figure 3B:
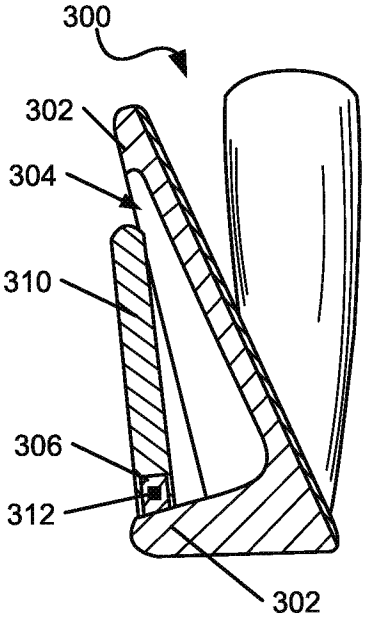

Boss members 306 may be designed to fit into openings 308 provided in a weight member 310 (e.g., in the ends of a bridge member, as shown in FIGS. 3A and 3B). Of course, the weight member 310 may take on a wide variety of different sizes, shapes, weights, weight distributions, and the like without departing from this invention. Optionally, if desired, plural weight members 310 may be attached to the various boss member(s) 306 without departing from this invention (e.g., one independent weight member attached to each independent boss member 306, etc.).

The weight member(s) 310 may be fixed in place with respect to the club head 300 and the boss member(s) 306 in any desired manner without departing from the invention. In this illustrated example, pin elements 312 are provided that extend through openings provided in the weight member 310 and the boss members 306. If desired, the pin elements 312 may be secured in place, e.g., once placed through the weight member 310 and the boss members 306, e.g., by a cotter pin 314, detents, spring-loaded retaining elements, threaded arrangements, or other securing mechanisms). As still another example, if desired, set screws may be provided, optionally that extend into openings or recesses defined in the boss members 306, to hold the bridge member 310 in place on the boss member(s) 306. Of course, other ways for holding the bridge member 310 in place with respect to the club head body 300 and the boss member(s) 306 may be used without departing from the invention, such as other threaded arrangements, mechanical connectors, clamps, clasps, and the like.

Alternatively, if desired, the club head body 300 may include the openings (e.g., in the surface of the perimeter weighting member 302), and the end(s) of one or more weight member(s) 310 may fit into (and be secured in) these openings (e.g., by structural retaining walls or elements; by detent mechanisms; by pins, set screws, threaded arrangements, clamps, clasps, or other mechanical connectors; etc.).

Figure 3C:
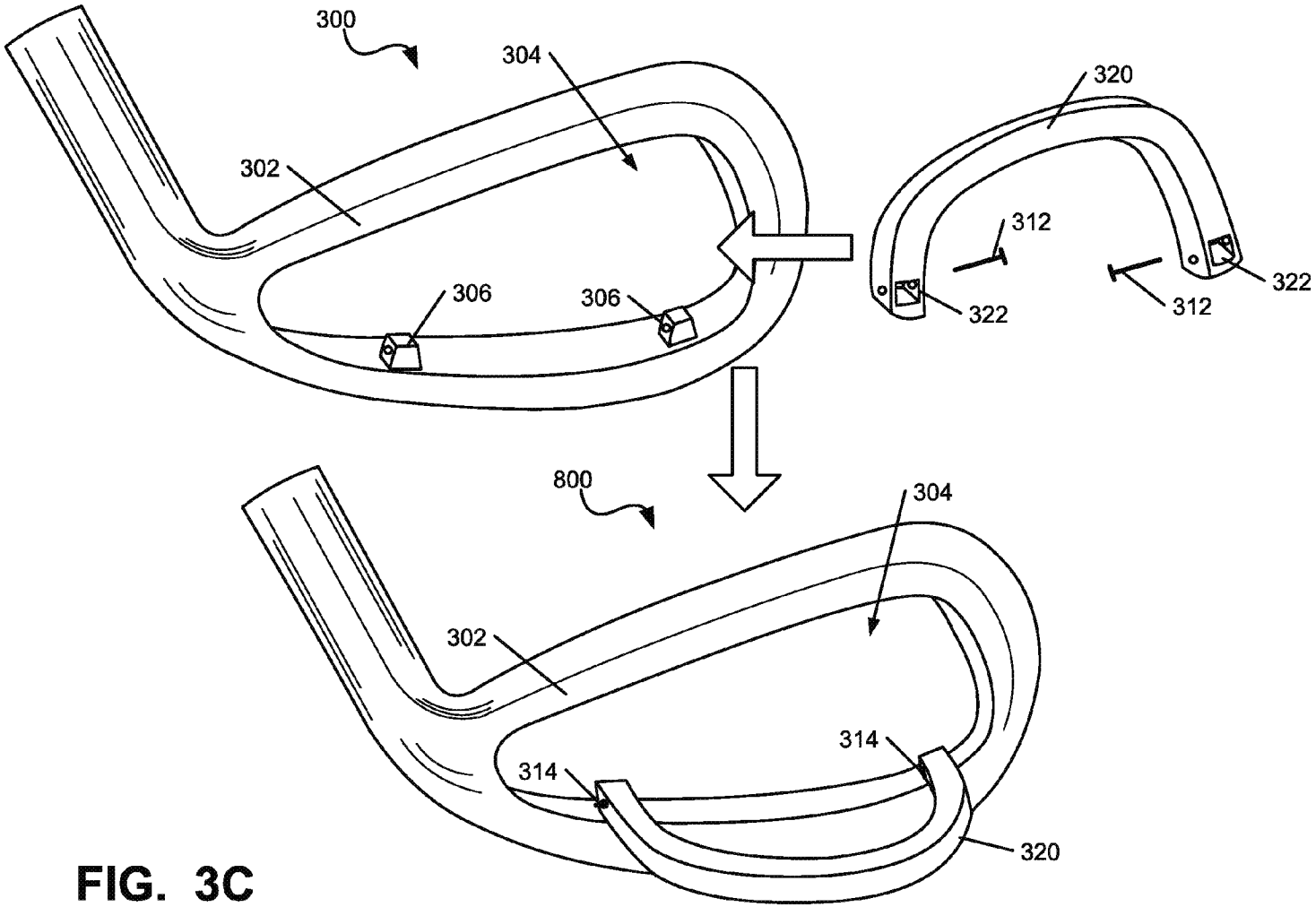

The bridge member 310 of FIGS. 3A and 3B can be readily attached to and removed from the remainder of the club head structure 300, e.g., by engaging and disengaging the pins 312 (or other securing mechanism) from the boss member(s) 306. This club head structure 300 retains the ability to provide an increased moment of inertia and/or to change the weighting and center of gravity characteristics by changing the overall shape of the club head structure 300. More specifically, in this example club head structure 300 according to the invention, rather than move the weight member 310 between the upright and extended positions in the manner described above in conjunction with FIGS. 1A through 2B, the shape, center of gravity, weighting, and/or moment of inertia characteristics of the club head structure 300 are changed by exchanging one weight member for another. FIGS. 3A and 3B illustrate the club head structure 300 with a weight member 310 attached, and this weight member 310 is arranged in the upright position. To change this club head 300 (as shown in FIGS. 3A and 3B) to a structure having a weight member in an extended position, weight member 310 is removed from the boss member(s) 306 (e.g., by removing the cotter pins 314, removing pins 312, and/or otherwise disengaging a locking or securing mechanism (if any and if necessary)). Then, as shown in FIGS. 3C and 3D, a different weight member 320 may be secured to the club head body 300. Weight member 320 of this example structure 300 includes openings 322 defined in lower side surfaces thereof for receiving the boss members 306. In this manner, the weight member 320 may be provided so as to extend from the perimeter weighted structure 302 in a direction away from the front of the club head body 300. If desired, the same securing mechanism(s) may be used to secure weight member 320 in place as used to secure weight member 310 in place (e.g., pin 312 and cotter pin 314, set screws, or the various other securing mechanisms described above), although different securing elements and/or mechanisms may be used without departing from the invention.

As another option, if desired, it is not necessary to provide two separate weight members 310 and 320 to produce the two weight member positions of FIGS. 3A through 3D. Rather, if desired, the openings (e.g., openings 308 and 322) for the two orientations may be provided on a single weight member structure. As still another potential alternative, if desired, a plurality of weighting members having a variety of different weighting characteristics and/or mounting orientations may be provided (e.g., as a kit) without departing from the invention (e.g., to give the user and/or club fitter numerous shape, center of gravity, weighting, and/or moment of inertia customization options, to allow selective heel or toe weighting, to allow fade or draw biasing, to allow hook or slice correction, etc.).

FIGS. 4A through 7C illustrate rear and cross-sectional views of yet additional example iron-type golf club heads that may be included in a golf club according to at least some examples of this invention. The examples of FIGS. 4A through 7C may be rear and cross-sectional views of an iron-type golf club head, such as the example golf club head 102 of FIG. 1A. Further, the features depicted in FIGS. 4A through 7C and described below may be incorporated into any desired form or shape without departing from the invention (e.g., a "blade" type iron, a hybrid type iron, etc.).

Figure 4A:
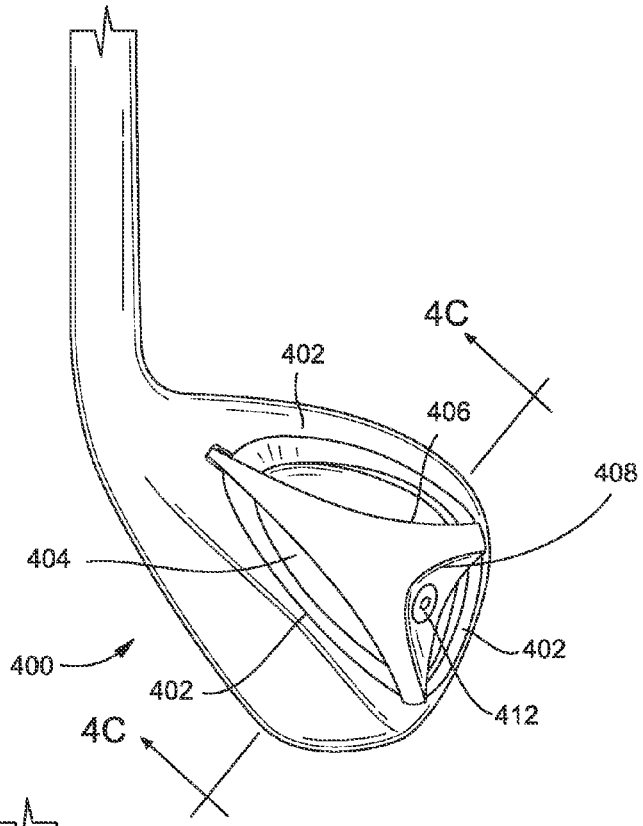
FIGS. 4A through 4C illustrate example features of additional example golf clubs and golf club heads in accordance with this invention (again, iron-type golf clubs and golf club heads are illustrated)
Figure 4B:
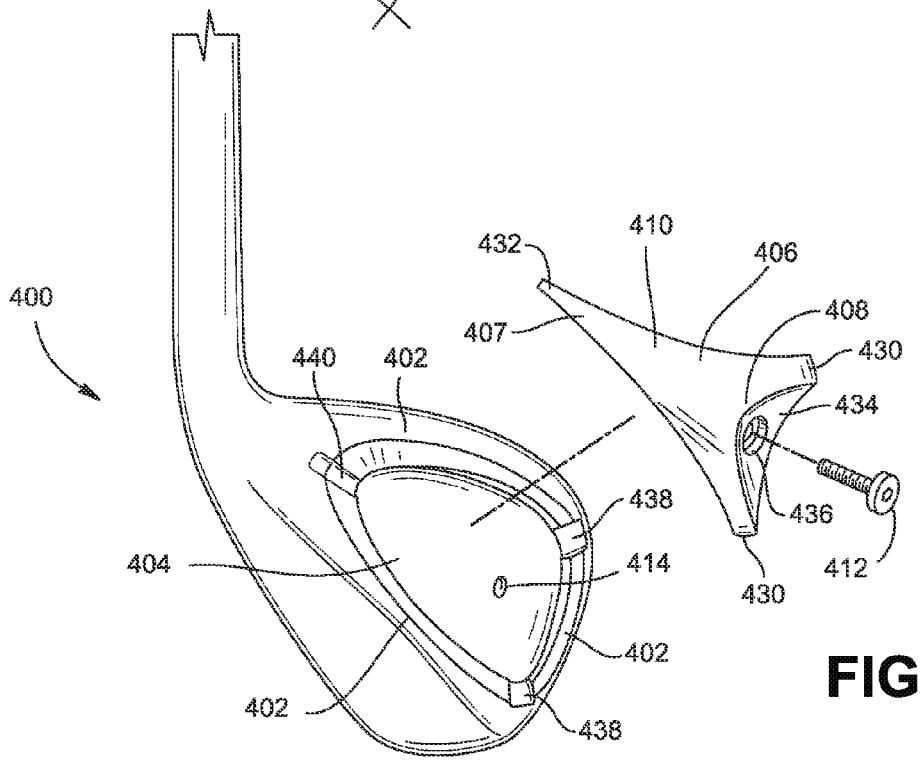
Figure 4C:
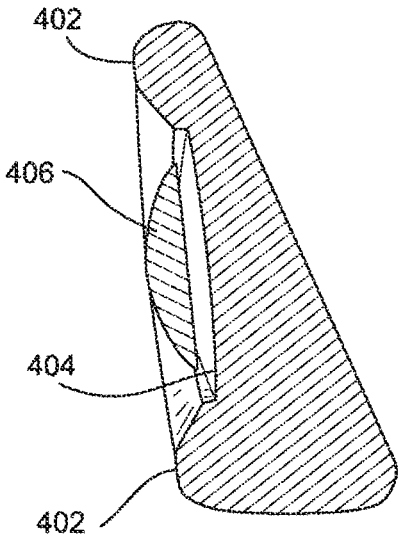

FIGS. 4A and 4B depict rear views of an additional example iron-type golf club head that may be included in a golf club for individual customization of characteristics of the golf club head. FIG. 4C depicts a cross-sectional view of the exemplary iron-type golf club head depicted in FIGS. 4A and 4B, wherein the cross-sectional cut is shown in FIG. 4A. In the example structure of FIGS. 4A through 4C, the particularly illustrated club head 400 has a club head body member and is formed as a perimeter weighted, cavity back club (note, for example, the perimeter weighting 402 and the rear cavity 404 defined in the back of the club head body 400). FIGS. 4A and 4C depict exemplary weight member 406 engaged at least partially within rear cavity 404. FIG. 4B depicts an exploded view of exemplary weight member 406 with golf club head 400. The exemplary weight member 406 may be generally triangular-shaped such that the weight of weight member 406 is concentrated in base side 408. Thus, the weight member 406 has a base side 408, or base portion 408 and a central portion 407 extending from the base portion 408. The base side 408 has a pair of vertices 430 and the central portion 407 has a central vertex 432. The base side 408 has a recessed portion 434. A countersunk aperture 436 is provided completely through the base side 408 of the weight member 406. In one exemplary embodiment, the aperture 436 is positioned at the recessed portion 434. As explained in greater detail below, the aperture receives a fastener for securing the weight member 406 to the club head 400. As further shown in FIGS. 4A and 4B, the respective sides of the triangular-shaped weight member 406 are curved inwardly towards a middle portion of the weight member 406. It is understood that the extent of the inward curvature as well as the size of the base side 408 and the central portion 407 can be controlled based on the amount of weight possessed by the weight member 406. As further shown in FIG. 4B, the rear side of the club head body member defining the rear cavity 404 has a plurality of receiving members. In one exemplary embodiment, a pair of receiving members 438 is positioned proximate one side of the rear cavity 404 and a central receiving member 440 is positioned proximate another side of the rear cavity 404. The receiving members 438, 440 may have inclined engaging surfaces to cooperate with portions of the weight member 406.

As depicted in FIGS. 4A through 4C, the triangular-shaped weight member 406 may be engaged within the rear cavity 404 such that a base side 408 of the triangular-shaped weight member 406 is positioned at least partially within the rear cavity 404 toward the toe end of the golf club head in one exemplary embodiment. As can be appreciated from FIGS. 4A and 4B, the pair of vertices 430 of the weight member 406 are positioned in the pair of receiving members 438 in surface to surface engagement and the central vertex 432 is positioned on the central receiving member 440. The vertices 430,432 extend past the rear side surface defining the rear cavity 404 although the vertices 430,432 could be flush with or positioned within the rear cavity 404 if desired. As explained below, the fastener 412 is positioned through the aperture 436 and into an opening in the club head body. The shape of the weight member 406 may be such that a portion extends into the rear cavity 404. As discussed, the base side 408 is positioned proximate the toe end of the club head. Such an orientation may push the respective center of gravity of the club head towards the toe of the club head. A positioning of the club head's center of gravity towards the toe end tends to increase the club head's moment of inertia, thus making the club head less resistant to creating a hook spin on a golf ball (i.e., a counter-clockwise spin for the right-handed golfer or a clockwise spin for the left-handed golfer). In alternative embodiments, the generally triangular-shaped weight member 406 may be oriented such that a base side 408 of the triangular-shaped weight member 406 is positioned toward the heel end of the golf club head, pushing the center of gravity of the club head towards the heel end of the club head. Such an alternative positioning of the club head's center of gravity towards the heel end tends to decrease the club head's moment of inertia, thus making the club head less resistant to creating a slice spin on a golf ball (i.e., a clockwise spin for the right-handed golfer or a counter-clockwise spin for the left-handed golfer). Weight member 406 may take on any desired shape or form without departing from the scope and spirit of the invention described herein. For example, the weight member 406 may be the shape of a cross, a trapezoid, an oblong (generally), a rectangle (generally), or other angular shape, without departing from the invention. Thus, the weight member 406 can be sized having a base side and central portion such that the base side can be positioned proximate the top end of the club head or the sole portion of the club head. Other intermediate positions could also be utilized by rotating the weight member 406 in clockwise or counterclockwise directions.

As described above, club head 402 and weight member 406 may be made of any desired materials without departing from this invention, including conventional materials known and used in the golf club construction art. For example, club head 402 and weight member 406 may be made from any of the specific materials described above with respect to the club head structure 102 of FIGS. 1A through 1E. Of course, those skilled in the art will recognize that a wide variety of other materials and/or combinations of materials also may be used in the construction of club head 402/weight member 406 without departing from this invention. Golf club head 400 may also be provided with multiple weight members 406, in varying weights, to incrementally alter the center of gravity or moment of inertia characteristics of the club head 400, so as to concentrate the weight towards the toe end, heel end, sole side or upper side of the respective weight member.

Weight member 406 may be secured in the rear cavity 404 of club head 400 by any appropriate means known to those skilled in the art without departing from the invention. As exemplified in FIGS. 4A and 4B, weight member 406 may be secured with a set screw 412 in threaded hole 414. It is understood that the set screw 412 passes through the aperture 436 as shown in FIG. 4B. However, if desired, a nut and bolt or other threaded arrangement may be provided. As additional examples, clamps, clasps, retaining elements, groove structures, detents, spring-loaded bolt members, and or other elements may be provided to removably, movably, and/or releasably hold weight member 406 in place with respect to the club head body 400.

Figure 5A:
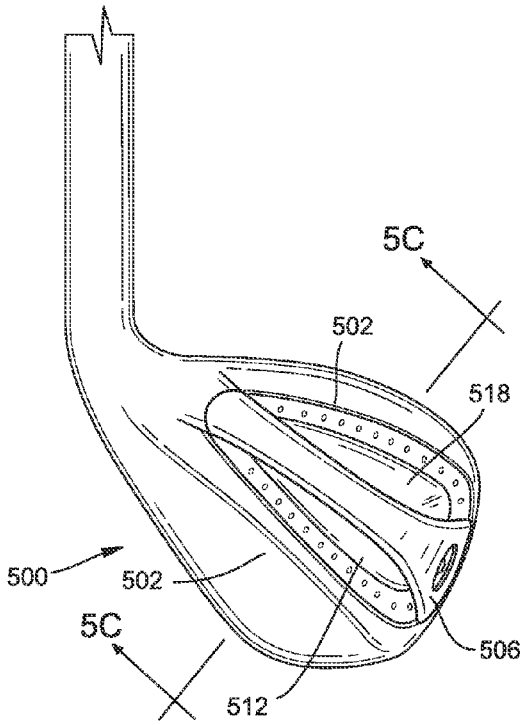
FIGS. 5A through 5C illustrate example features of additional example golf clubs and golf club heads in accordance with this invention (again, iron-type golf clubs and golf club heads are illustrated)
Figure 5B:
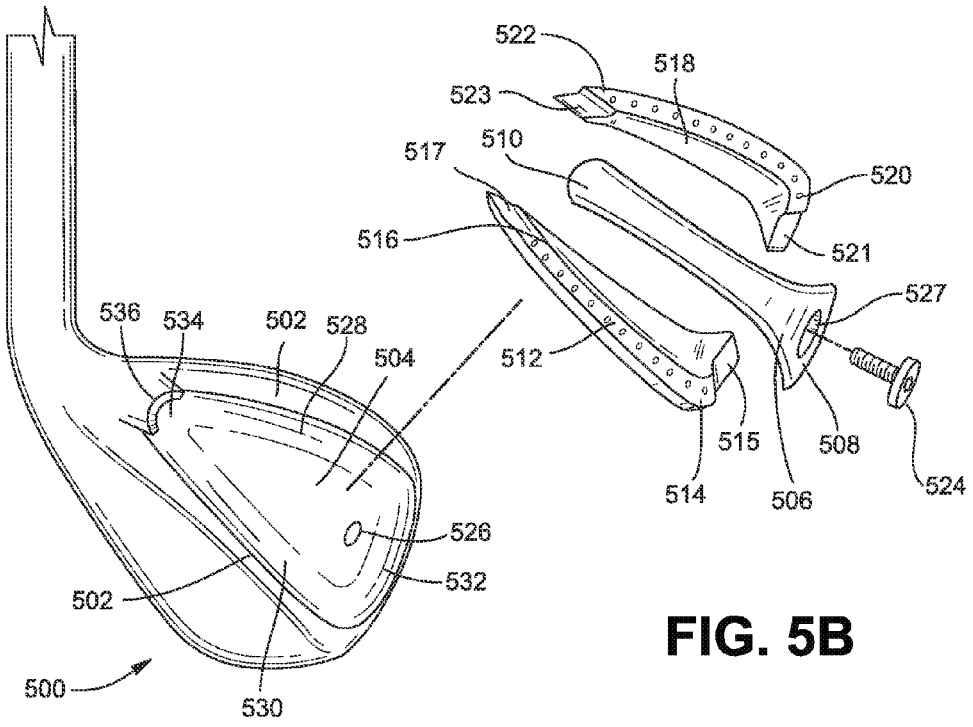
Figure 5C:
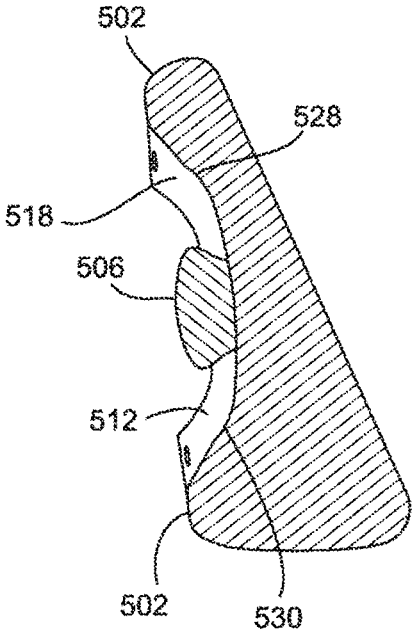

FIGS. 5A and 5B depict rear views of an additional example iron-type golf club head that may be included in a golf club for individual customization of characteristics of the golf club head. FIG. 5C depicts a cross-sectional view of the exemplary iron-type golf club head depicted in FIGS. 5A and 5B, wherein the cross-sectional cut is shown in FIG. 5A. The example structures of FIGS. 5A through 5C particularly illustrate a club head 500, formed as a perimeter weighted, cavity back club (note, for example, the perimeter weighting 502 and the rear cavity 504 defined in the back or rear surface of the club head body member 500). As further shown, the rear cavity 504 is defined by peripheral edges including an upper peripheral edge 528, a lower peripheral edge 530 proximate the sole of the club head body, a toe end peripheral edge 532 and a heel end peripheral edge 534. These peripheral edges collectively define the outer bounds of the rear cavity 504. The rear cavity 504 extends into the club head body 500 towards the ball striking face opposite the rear surface. FIGS. 5A and 5C depict a weighting assembly that in one embodiment, has a plurality of exemplary weight members 506, 512, 518 engaged at least partially within rear cavity 504. FIG. 5B depicts an exploded view of the exemplary weight members 506, 512 and 518 with golf club head 500. According to at least one embodiment of the invention, the exemplary weight members 512 and 518 underlay the weight member 506 within, or at least partially within the rear cavity 504. As depicted in FIGS. 5A and 5B, the first weight member, or the first underlay weight member 512, has a toe end 514 with a recessed area 515 and a heel end 516 with a recessed area 517. The first underlay weight member 512 further has a central surface extending between the recessed surfaces 515,517. The central surface defines an upper edge. Similarly, the second underlay weight member 518 has a toe end 520 with a recessed area 521 and a heel end 522 with a recessed area 523. The second underlay weight member 518 also has a central surface extending between the recessed surfaces 521,523. The central surface defines a lower edge. The underlay weight members 512 and 518 may be shaped to conform to the rear cavity 504, along the sole side of the rear cavity 504 and along the upper end side of the rear cavity 504, respectively. Thus, the underlay weight members 512,518 are generally in confronting relation to the peripheral edges in the rear face defining the rear cavity 504. The overlay weight member 506 has a toe end 508 having outwardly flared distal edges and a heel end 510. An aperture is located at the toe end 508 for receiving a fastener described in greater detail below. The overlay weight member 506 is dimensioned in length to generally span across the rear cavity from the heel end to the toe end.

FIGS. 5A and 5C depict the weighting assembly connected to the club head body member 500. As can be appreciated from FIGS. 5B and 5C, the first underlay weight member 512 is positioned in the rear cavity 504 wherein its lower edge is proximate the lower peripheral edge 530 defining the rear cavity 504. The second underlay weight member 518 is positioned in the rear cavity 504 wherein its upper edge is proximate the upper peripheral edge 528 defining the rear cavity 504. The respective toe ends 514, 520 of the underlay weight members 512, 518 confront one another wherein the respective recessed areas 515, 521 meet to cooperatively form a first interface area. Similarly the respective heel ends 516, 522 confront one another wherein the respective recessed areas 517, 523 meet to cooperatively form a second interface area. The overlay weight member 506 is positioned and secured over underlay weight members 512 and 518, such that the toe end 508 of overlay weight member 506 is received in the toe end recess areas 515, 521 of the underlay weight members 512, 518, and at the first interface area. It is understood that the flared edges of the toe end 508 of the overlay member 506 are dimensioned to fit flush into the recess areas 515, 521. Similarly, as positioned, the heel end 510 of overlay weight member 506 is received in the heel end recess areas 517 and 523 of the underlay weight members 512, 518, and at the second interface area. As can be appreciated from FIG. 5B, the club head body member 500 may also have a facing surface 536 to cooperate with the heel end 510 of the overlay member 506. As further shown in FIG. 5A, a lower edge of the overlay member 506 extends beyond the upper edge of the first underlay weight member 512 and an upper edge of the overlay member 506 extends beyond the lower edge of the second underlay weight member 518. A pair of pockets may be defined at the interface between the overlay member 506 and the central surfaces of the underlay weight members 512, 518. As discussed in greater detail below, a fastener is secured through the aperture in the overlay member 506 to secure the weighting assembly to the club head body member 500.

Overlay weight member 506 may be shaped and weighted such that a majority of the weight is concentrated in the toe end 508 of the weight member, thus pushing the center of gravity toward the toe end of the club head and tending to increase the club head's moment of inertia about at least one axis with respect to the club head. Alternatively, overlay weight member may be shaped and weighted such that a majority of the weight is concentrated in the heel end 510 of the weight member, thus pushing the center of gravity towards the heel end of the club head and tending to decrease the club head's moment of inertia about at least one axis with respect to the rest of the club head. For example, the overlay weight member 506 may be shaped as depicted in FIGS. 5A and 5B with a tapered toe end 508 (defining the flared distal edges) and a less tapered heel end 510. However, weight member 506 may take on any desired shape or form without departing from the scope and spirit of the invention described herein. Overlay weight member 506 may alternatively be the shape of a cross, a triangle (generally), an oblong (generally), a rectangle (generally), or other angular shape, without departing from the invention.

Underlay weight members 512 and 518 may generally be shaped to conform to at least a portion of the rear cavity 504 at the sole side of rear cavity 504 and the upper end of the rear cavity 504, respectively. As discussed, respective outer peripheral edges of the first and second underlay weight members 512,518 are positioned proximate the peripheral edges 530, 528 on the rear face of the club head body 500 defining the rear cavity 504. Additionally, underlay weight members 512 and 518 may have the same weight or different weights, depending on the golf club head characteristics desired. For example, the first weight member 512 at the sole-end may be more dense, and thus heavier, than the second, or upper-end weight member 518, tending to push the center of gravity lower in the club head. Alternatively, the upper-end weight member 518 may be less dense, and thus lighter, than sole-end weight member 512, tending to push the center of gravity higher in the club head.

As described above, the club head 500 and weight members 506, 512 and 518 may be made of any desired materials without departing from this invention, including conventional materials known and used in the golf club construction art. For example, the club head 500 and weight members 506, 512 and 518 may be made from any of the specific materials described above with respect to the club head structure 102 of FIGS. 1A through 1E. Of course, those skilled in the art will recognize that a wide variety of other materials and/or combinations of materials also may be used in the construction of club head 500/weight members 506, 512 and 518 without departing from this invention. Golf club head 500 may also be provided with multiple weight members, such as a set of weight members similar to weight members 506, 512 and 518, in varying weights, to enable an incremental alteration in the center of gravity or moment of inertia characteristics of the club head 500. For example, alternative embodiments may include weight members 506, 512 and 518 that are shaped so as to concentrate the weight in either the toe end or the heel end of the respective weight member.

The weight members 506, 512, 518 may be secured in the rear cavity 504 of club head 500 by any appropriate means known to those skilled in the art without departing from the invention. As depicted in FIGS. 5A and 5B, weight member 506 may be secured with a set screw 524 through weight member aperture 527 and club head aperture 526, such that set screw 524 and the positioning of weight member 506 over weight members 512 and 518 secures the entire weight assembly in place. Thus, the first and second underlay weight members 512, 518 are sandwiched between the rear side of the club head 500 and the overlay weight member 506. However, if desired, a nut and bolt or other threaded arrangement may be provided. As additional examples, clamps, clasps, retaining elements, groove structures, detents, spring-loaded bolt members, and or other elements may be provided to removably, movably, and/or releasably hold weight members 506, 512 and 518 in place with respect to the club head body 500.

Figure 6A:
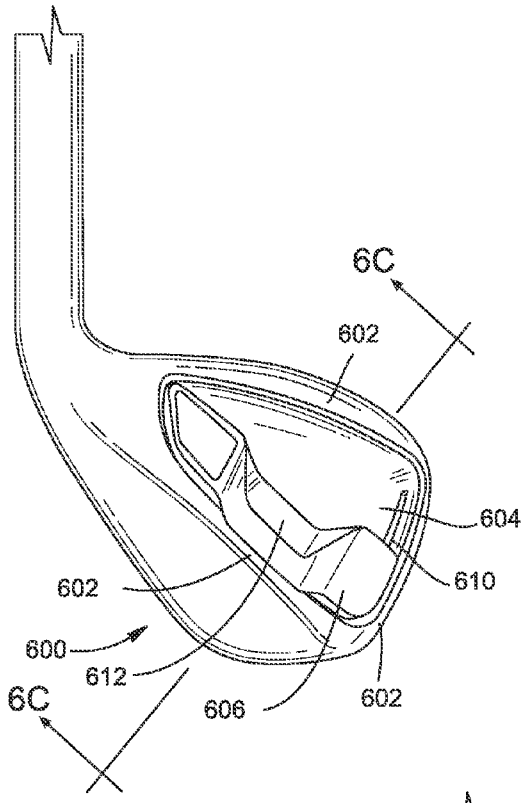
FIGS. 6A through 6D illustrate example features of additional example golf clubs and golf club heads in accordance with this invention (again, iron-type golf clubs and golf club heads are illustrated)
Figure 6B:
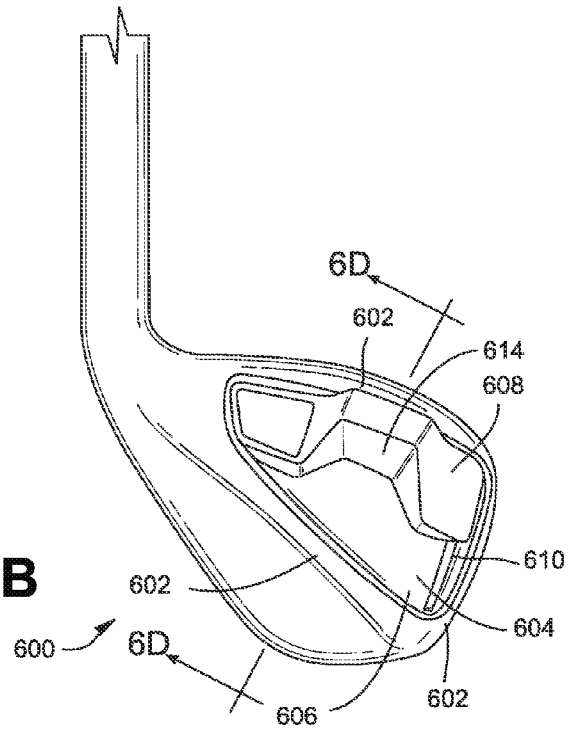
Figure 6C:
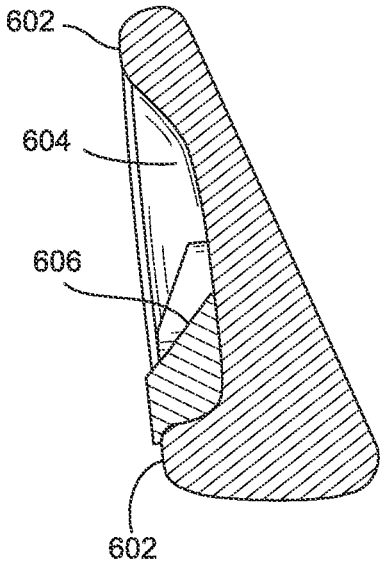
Figure 6D:
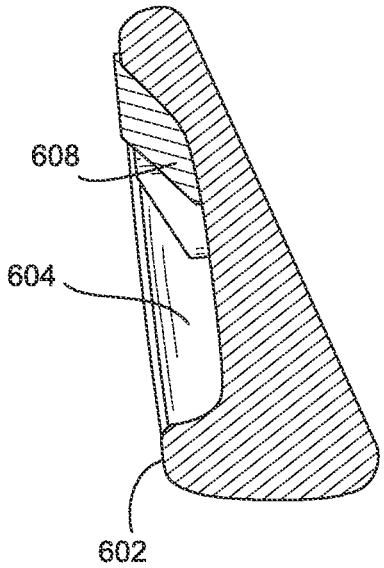

FIGS. 6A and 6B depict rear views of an additional example iron-type golf club head that may be included in a golf club for individual customization of characteristics of the golf club head. FIGS. 6C and 6D depict cross-sectional views of the exemplary iron-type golf club head depicted in FIGS. 6A and 6B, respectively, wherein the cross-sectional cuts are shown in FIGS. 6A and 6B. In the example structure of FIGS. 6A through 6D, the particularly illustrated club head 600 is again formed as a perimeter weighted, cavity back club (note, for example, the perimeter weighting 602 and the rear cavity 604 defined in the back of the club head body 600). FIGS. 6A and 6C depict exemplary weight member 606 engaged at least partially within rear cavity 604 at the sole-end of the cavity. FIGS. 6B and 6D depict exemplary weight member 608 engaged at least partially within rear cavity 604 at the upper-end of the cavity. The exemplary weight members 606 and 608 may be generally rectangular-shaped, as depicted in FIGS. 6A and 6B, and the rectangular-shaped weight members 606 and 608 may be engaged within rear cavity 604 such that the weight members partially conform to the sole-end and the upper-end of cavity 604, respectively. The positioning of weight member 606 towards the sole-end of the club head may push the respective center of gravity of the club head lower in the club head. A positioning of the club head's center of gravity towards the sole of the club may assist the golfer in getting a golf ball airborne, or to increase the vertical trajectory of the golf ball. The positioning of weight member 608 towards the upper-end of the club head may push the respective center of gravity of the club head higher in the club head. A positioning of the club head's center of gravity towards the upper-end of the club head may create a flatter golf ball trajectory.

The weight members 606 and 608 may take on any desired shape or form without departing from the scope and spirit of the invention described herein. For example, the weight members 606 and 608 may be shaped to conform to, and visually blend in with the rear cavity 604 for aesthetics. As shown in FIGS. 6A and 6B, the weight members 606, 608 may be generally rectangular-shaped with recessed areas 612,614 at a central portion of the members 606, 608, such that the generally rectangular-shaped weight members also take on a general U-shape. Weight members 606 and 608 may take on still other shapes and characteristics without departing from the invention.

As described above, the club head 600 and weight member 606 or 608 may be made of any desired materials without departing from this invention, including conventional materials known and used in the golf club construction art. For example, the club head 600 and weight member 606 or 608 may be made from any of the specific materials described above with respect to the club head structure 102 of FIGS. 1A through 1E. Of course, those skilled in the art will recognize that a wide variety of other materials and/or combinations of materials also may be used in the construction of club head 600/weight member 606 or 608 without departing from this invention. Golf club head 600 may also be provided with a set of multiple weight members, such as weight member 606 or 608 in varying weights, to allow for incremental changes to the center of gravity or moment of inertia characteristics of the club head 600. For example, alternative embodiments may include a weight member 606 or 608 that is shaped so as to concentrate the weight in either the toe end or the heel end of the respective weight member.

Weight members 606 and 608 may be secured in the rear cavity 604 of club head 600 by any appropriate means known to those skilled in the art without departing from the invention. As depicted in FIGS. 6A and 6B, weight member 606 and 608 may be secured by engaging a narrow projection (not shown) in groove 610 within rear cavity 604. However, if desired, a set screw, a nut and bolt, or other threaded arrangement may be provided. As additional examples, clamps, clasps, retaining elements, detents, spring-loaded bolt members, and or other elements may be provided to removably, movably, and/or releasably hold weight member 606 or 608 in place with respect to the club head body 600.

Figure 7A:
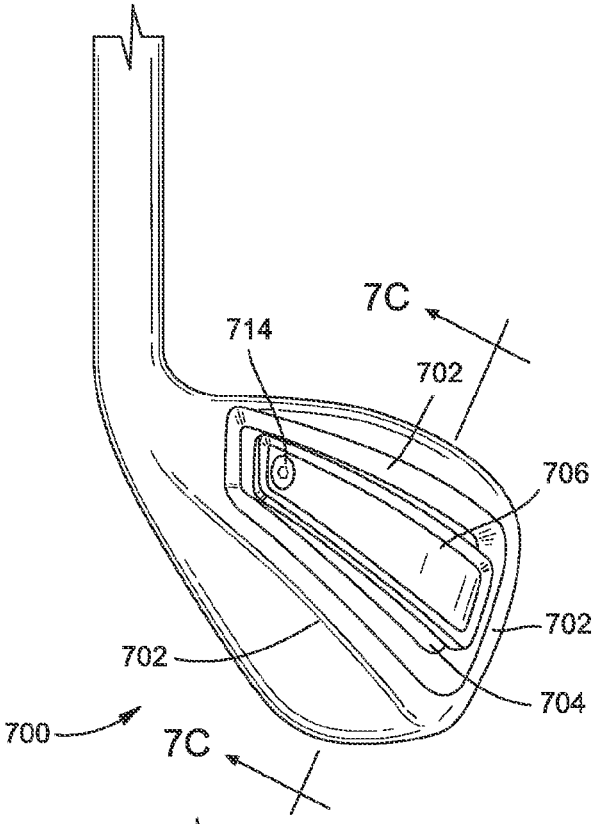
FIGS. 7A through 7C illustrate example features of additional example golf clubs and golf club heads in accordance with this invention (again, iron-type golf clubs and golf club heads are illustrated).
Figure 7B:
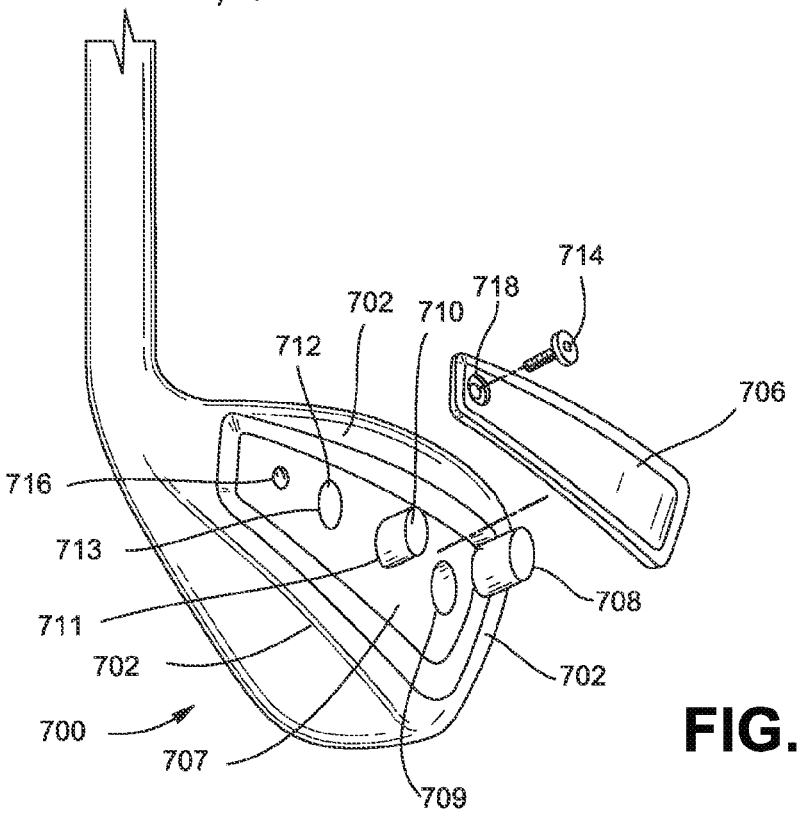
Figure 7C:
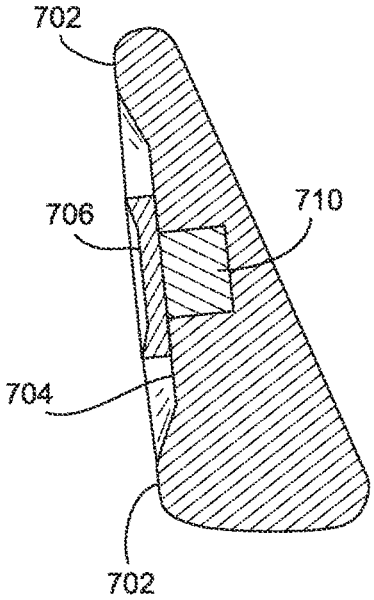

FIGS. 7A and 7B depict rear views of an additional example iron-type golf club head that may be included in a golf club for individual customization of center of gravity and/or moment of inertia characteristics of the golf club head. FIG. 7C depicts a cross-sectional view of the exemplary iron-type golf club head depicted in FIGS. 7A and 7B, wherein the cross-sectional cut is shown in FIG. 7A. In the example structure of FIGS. 7A through 7C, the particularly illustrated club head 700 is formed as a perimeter weighted, cavity back club (note, for example, the perimeter weighting 702 and the rear cavity 704 defined in the back of the club head body member 700). FIGS. 7A and 7C depict club head 700 with an exemplary weighting assembly (only bridge member 706 is visible in FIG. 7A) engaged at least partially within rear cavity 704. FIG. 7B depicts club head 700 with an exploded view of the weighting assembly (including bridge 706, weight receptacle 707 and weight members/pins 708, 710 and 712). The exemplary weight members 708, 710 and 712 may be pin-shaped, as depicted in FIG. 7B, and the weight members 708, 710 and 712 may be engaged within recesses 709, 711 and 713, respectively, within weight receptacle 707 in rear cavity 704. Further, bridge member 706 may be secured over the weight receptacle 707 with weights 708, 710, 712 and recesses 709, 711, 713 to inhibit movement of the weights as well as for aesthetics.

Weights/pins 708, 710 and 712 may be similarly weighted, or may be of varying weights such that when received in recesses 709, 711, and 713, the respective center of gravity of club head 700 may be shifted towards the toe end or the heel end of the club head. As previously described, a positioning of the club head's center of gravity towards the toe end or the heel end tends to increase or decrease, respectively, the club head's moment of inertia. In other manners of use of the exemplary embodiment depicted in FIGS. 7A through 7C, one or all of weights 708, 710 and 712 may be removed from the weighting assembly altogether to thereby effect the center of gravity characteristics of club head 700.

Weights 708, 710 and 712 are depicted as cylindrical pins, however the weights 708, 710 and 712 may take on any desired shape or form without departing from the scope and spirit of the invention described herein. For example, weights 708, 710, 712 may be rectangular, cone-shaped or other angular shape, without departing from the invention. Furthermore, more or fewer weights/recesses may be provided in the weight receptacle 707 without departing from the invention.

As described above, the club head 700, weights 708, 710 and 711, weight receptacle 707, and bridge member 706 may be made of any desired materials without departing from this invention, including conventional materials known and used in the golf club construction art. For example, the weighting assembly may be made from any of the specific materials described above with respect to the club head structure 102 of FIGS. 1A through 1E. Of course, those skilled in the art will recognize that a wide variety of other materials and/or combinations of materials also may be used in the construction of club head 700/weighting assembly without departing from this invention. Golf club head 700 may also be provided with multiple sets of pins/weights, having varying weights, for incremental alteration of the center of gravity or moment of inertia characteristics of the club head 700. For example pins/weights may be selected/deselected so as to concentrate any added weight towards the toe end, heel end, sole side or upper side of the golf club head.

The weighting assembly depicted in FIGS. 7A through 7C may be secured in the rear cavity 704 of club head 700 by any appropriate means known to those skilled in the art without departing from the invention. As depicted in FIGS. 7A and 7B, bridge member 706 may be secured over the weight receptacle 707 and weights 708, 710, 712 with a set screw 714 in threaded hole 716 in the club head as well as through an aperture 718 in the bridge member 706. However, if desired, a nut and bolt or other threaded arrangement may be provided. In such fashion, the weights 708, 710, 712 are generally sandwiched between the rear face of the club head 700 and the bridge member 706. As additional examples, clamps, clasps, retaining elements, groove structures, detents, spring-loaded bolt members, and or other elements may be provided to removably, movably, and/or releasably hold weights 708, 710, 712 in respective recesses 709, 711, 713 and to further hold the entire weighting assembly in place with respect to the club head body 700. As another example, weight receptacle 707 may be formed as part of the cavity back golf club head 700 or may be a separate member, as depicted, secured by means known to those of skill in the art. It is further understood that three weights are used in one exemplary embodiment of the invention. The weights are also positioned in a generally horizontal row across the club head 700. Other numbers of weights could also be used in other embodiments. The weights could also be positioned in other configurations.

III. Conclusion

In addition to iron-type golf clubs (including hybrid type clubs), as described in detail above, aspects of this invention also may be used in conjunction with putter heads and putters, wedges, wood and hybrid type golf club head and clubs. For example, rotatable and/or downwardly adjustable bridge or other structural members, e.g., of the types illustrated in FIGS. 1A through 7B, may be provided for use with a putter head without departing from the invention. The adjustable weights and/or body members may be readily adjusted and/or secured in place with respect to the remainder of the golf club head in any desired manner, including the various manners described above. Of course, if desired, the various weight members (e.g., bridge member(s), movable weight(s), movable body member(s), etc.) may be included in any desired combination on a single club head structure (any type of club head structure) without departing from this invention.

Golf clubs and golf club heads in accordance with examples of the present invention also may be incorporated into a set, e.g., sets including one or more of woods, irons, wedges, hybrid type golf clubs, and/or putters. As more specific examples, aspects of the present invention may be used to provide a club set with increasing numbered woods and/or iron golf clubs, such as a driver and/or two or more of fairway woods, hybrid type clubs, a zero iron through a ten iron, various wedges (e.g., a pitching wedge, a lob wedge, a gap wedge, and a sand wedge, etc.), putters, etc. With at least some examples of the present invention, a golfer, a club designer, and/or a club fitter may select and/or modify the position and/or other properties of the adjustable weight(s), bridge member(s), and/or body member(s) for each golf club to meet the player's unique requirements, skill, or playing style. For each club in the set, the adjustable weight(s), bridge member(s), body member(s), and/or other features of the club head may be progressively changed and/or positioned to alter the center of gravity of one club member with respect to the others in the set, to make the center of gravity better suited for use of the particular club, optionally customized for use by a specific golfer.

Moreover, while aspects of this invention may be particularly well suited for use by youngsters, beginners, or high handicappers (e.g., to help make the ball easier to hit, to make the ball fly straighter, to help get the ball airborne, to help eliminate ball flight problems (such as excessive fades, draws, hooks, or slices, etc.)), the clubs and club heads are not limited to use by these categories of players. At least some club heads and clubs that include features and aspects of the invention may be designed (e.g., as described above) to conform to the current USGA (or other) Rules of Golf (e.g., at least in their non-extended orientation). Therefore, players at any skill level and/or in any environment (e.g., in formal competitions, for handicapping purposes, etc.) may take advantage of clubs and club heads that incorporate features and aspects of the invention. Additionally, by providing mechanisms that allow easy movement or changing of the weight member positions, the clubs and club heads may be transformed from a teaching aide or a beginner's club to fully conforming clubs and club heads (e.g., for use in formal competitions, for handicap purposes, as the player's game improves, etc.). In this manner, a player need not purchase a teaching or beginner set of clubs and then later be required to incur the added expense of purchasing a rule compliant club set.

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1-7A may be used individually and/or in any combination or subcombination without departing from this invention.

We claim:

1. A golf club head, comprising:

a club head body member having a ball-striking face, a sole, a cavity defined in the club head body member rearward of the face, an upper end, a toe end and a heel end, wherein the heel end is adjacent to a shaft-connecting member, the club head body member further having a hole located within the cavity;

an insert member engaged at least partially within the cavity such that the insert member is rotatable between different positions, the insert member having an aperture extending completely therethrough;

a fastener passing through the aperture and engaged with the hole in the club head body member to secure the insert member to the club head body member; and a plurality of receiving members positioned proximate the cavity, wherein the receiving members have inclined engaging surfaces configured to cooperate with portions of the insert member, wherein the insert member has a pair of vertices, wherein the pair of vertices extend past a rear side surface defining the cavity and are positioned in the pair of receiving members, and wherein the insert member is configured such that rotation of the insert member shifts the center of gravity of the golf club head.

2. The golf club head of claim 1, wherein the insert member is generally triangular-shaped.

3. The golf club head of claim 1, wherein the insert member is positioned proximate the rear end of the golf club head body member.

4. The golf club head of claim 1 wherein the insert member has a central vertex and the cavity defines a central receiving member, wherein the central vertex is positioned on the central receiving member.

5. The golf club head of claim 1 wherein the insert member is generally triangularly-shaped, wherein sides of the insert member are curved inwardly towards a middle portion of the insert member.

6. The golf club head of claim 1, wherein the fastener is a set screw, and the hole is a threaded hole.

7. A golf club, comprising:

a club head body member having a ball-striking face, a sole, a cavity defined in the club head body member rearward of the face, an upper end, a toe end and a heel end, wherein the heel end is adjacent to a shaft-connecting member, the club head body member further having a hole located within the cavity;

an insert member engaged at least partially within the cavity such that the insert member is rotatable between different positions, the insert member having an aperture extending completely therethrough;

a fastener passing through the aperture and engaged with the hole in the club head body member to secure the insert member to the club head body member, wherein the insert member is configured such that rotation of the insert member shifts the center of gravity of the golf club head;

a plurality of receiving members positioned proximate the cavity, wherein the receiving members have inclined engaging surfaces configured to cooperate with portions of the insert member;

wherein the insert member has a pair of vertices, wherein the pair of vertices extend past a rear side surface defining the cavity and are positioned in the pair of receiving members; and a shaft member engaged with the shaft-connecting member of the club head body member.

8. The golf club of claim 7, wherein the fastener is a set screw, and the hole is a threaded hole.

9. A golf club head, comprising:

a club head body member having a ball-striking face, a sole, a cavity defined in the club head body member rearward of the face, an upper end, a toe end and a heel end, wherein the heel end is adjacent to a shaft-connecting member, the club head body member further having a plurality of engaging surfaces positioned around the cavity;

an insert member engaged at least partially within the cavity such that the insert member is rotatable between different positions, and wherein the engaging surfaces cooperate with portions of the insert member to hold the insert member in position; and a fastener engaged with the insert member and the club head body member to secure the insert member to the club head body member, wherein the insert member is configured such that rotation of the insert member shifts the center of gravity of the golf club head, and wherein the portions of the insert member that cooperate with the engaging surfaces include at least a pair of vertices, wherein the pair of vertices extend past a rear side surface defining the cavity and engage a pair of the engaging surfaces.

10. The golf club head of claim 9, wherein the club head body member further has a hole located within the cavity, the insert member having an aperture extending completely therethrough, and the fastener is engaged with the hole in the club head body member to secure the insert member to the club head body member.

11. The golf club head of claim 10, wherein the hole is a threaded hole, and wherein the fastener comprises a set screw passing through the aperture and engaged with the threaded hole in the club head body member to removably secure the insert member to the club head body member.

12. The golf club head of claim 9, wherein the portions of the insert member that cooperate with the engaging surfaces include at least a central vertex and the plurality of engaging surfaces positioned around the cavity define a central engaging surface, wherein the central vertex extends past the rear side surface and engages the central engaging surface.

13. The golf club head of claim 9, wherein the insert member is generally triangular-shaped.

14. The golf club of claim 13, wherein the club head body member further has a hole located within the cavity, the insert member having an aperture extending completely therethrough, and wherein the fastener is engaged with the hole in the club head body member to removably secure the insert member to the club head body member.

15. The golf club of claim 14, wherein the hole is a threaded hole, and wherein the fastener comprises a set screw passing through the aperture and engaged with the threaded hole in the club head body member to removably secure the insert member to the club head body member.

16. The golf club head of claim 9, wherein the insert member is positioned proximate the rear end of the golf club head body member.

17. A golf club, comprising:

a club head body member having a ball-striking face, a sole, a cavity defined in the club head body member rearward of the face, an upper end, a toe end and a heel end, wherein the heel end is adjacent to a shaft-connecting member, the club head body member further having a plurality of engaging surfaces positioned around the cavity;

an insert member engaged at least partially within the cavity such that the insert member is rotatable between different positions, and wherein the engaging surfaces cooperate with portions of the insert member to hold the insert member in position;

a fastener engaged with the insert member and the club head body member to removably secure the insert member to the club head body member, wherein the insert member is configured such that rotation of the insert member shifts the center of gravity of the golf club head;

wherein the portions of the insert member that cooperate with the engaging surfaces include at least a pair of vertices, wherein the pair of vertices extend past a rear side surface defining the cavity and engage a pair of the engaging surfaces; and a shaft member engaged with the shaft-connecting member of the club head body member.

* * * * *